United States Patent [19]

Sernetz

[11] Patent Number: 4,716,603

[45] Date of Patent: Jan. 5, 1988

[54] SWIMMING POOL COVER

[76] Inventor: Heinz Sernetz, Jungberg 3, Gleisdorf A-8200, Austria

[21] Appl. No.: 281,292

[22] Filed: Jul. 7, 1981

[30] Foreign Application Priority Data

Jul. 9, 1980 [AT] Austria ..... 3581/80

[51] Int. Cl.[4] ..... E04H 3/19

[52] U.S. Cl. ..... 4/501

[58] Field of Search ..... 4/495, 499, 501

[56] References Cited

U.S. PATENT DOCUMENTS

| | | | |
|---|---|---|---|
| 3,039,453 | 6/1952 | Andrassy . | |
| 3,184,763 | 5/1965 | Kennedy | 4/501 X |
| 3,242,503 | 3/1966 | Russo . | |
| 3,423,768 | 1/1969 | Glenn | 4/501 |
| 3,813,704 | 6/1974 | Troiano | 4/499 |
| 3,927,427 | 12/1975 | Aine | 4/499 |
| 4,151,617 | 5/1979 | Kinzel | 4/499 |
| 4,229,843 | 10/1980 | Belanger | 4/501 X |
| 4,364,131 | 12/1982 | Clerk | 4/501 X |

FOREIGN PATENT DOCUMENTS

| | | | |
|---|---|---|---|
| 326321 | 12/1975 | Austria . | |
| 2452550 | 5/1976 | Fed. Rep. of Germany . | |
| 2453458 | 5/1976 | Fed. Rep. of Germany . | |
| 2513645 | 10/1976 | Fed. Rep. of Germany . | |
| 2516204 | 10/1976 | Fed. Rep. of Germany . | |
| 2552559 | 6/1977 | Fed. Rep. of Germany . | |
| 2633581 | 2/1978 | Fed. Rep. of Germany . | |
| 2724287 | 12/1978 | Fed. Rep. of Germany . | |
| 527995 | 10/1972 | Switzerland . | |
| 580734 | 10/1976 | Switzerland . | |
| 2031273 | 4/1980 | United Kingdom | 4/499 |
| 2033572 | 5/1980 | United Kingdom . | |

*Primary Examiner*—Charles E. Phillips

*Attorney, Agent, or Firm*—Kurt Kelman

[57] ABSTRACT

The cover for a swimming pool has a side facing the water and an opposite side facing away. The cover defines an elongated cavity having a single flooding opening facing the water and arranged at one end of the cavity for flooding the pool, the cavity having a venting port at an end thereof opposite to the one end having the flooding opening. A vent valve in the port can close the port and a connection to a source of gas under pressure leads to the cavity for supplying the gas under pressure to the cavity to displace the water in the cavity. The mass of the cover exceeds that of the displaced water in case the cavity or cavities are flooded.

17 Claims, 11 Drawing Figures

Fig.4
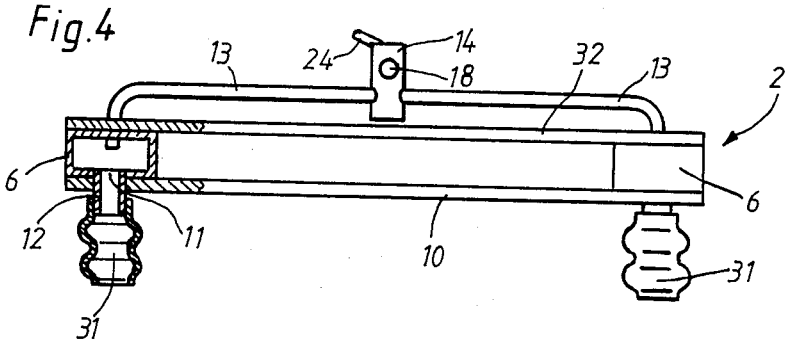
Fig.5
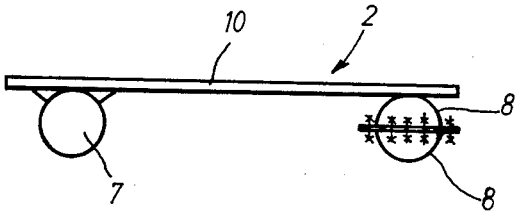
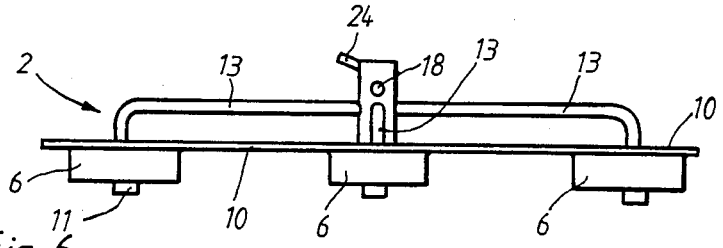
Fig. 6
Fig.7
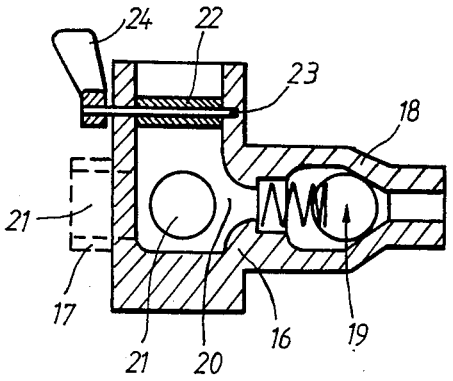

Fig.10
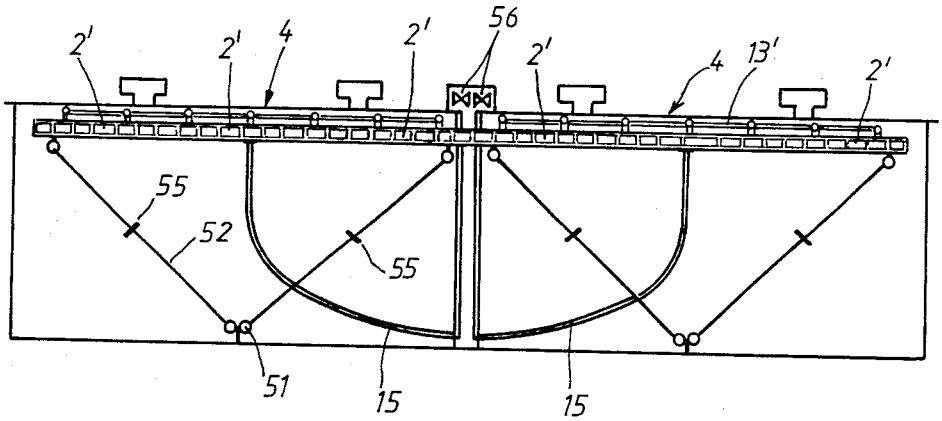
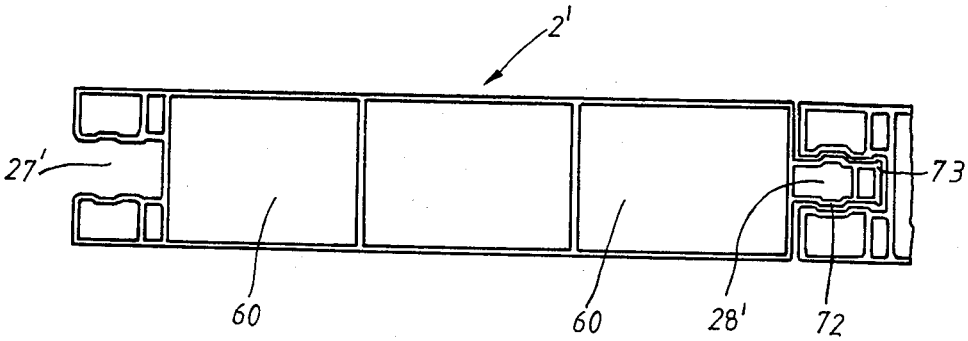
Fig.11

SWIMMING POOL COVER

The present invention relates to a cover for a pool containing a liquid, such as a swimming pool filled with water.

U. S. Pat. No. 3,423,768 discloses such a cover having elongated cavities which may be connected to a source of gas under pressure and each cavitiy has a plurality of openings facing the liquid for flooding the cavity. A flexible tube connects each cavity to the gas source and the tube interconnects all the cavities of the cover. The mass of the cover exceeds that of the displaced liquid in case of flooded cavities. The large number of flooding openings causes a substantially simultaneous sinking and rising of the entire cover, which engenders considerable force and requires correspondingly strong guides for the cover.

It is the primary object of this invention to provide a cover of this general type but which is free of the indicated disadvantages.

The above and other objects are accomplished according to the invention by providing a single flooding opening for each cavity, the cavity having a venting port at an end thereof opposite to the one end having said flooding opening, a vent valve in the port for closing and opening said port and a connection to a source of gas under pressure leading to the cavity.

With this arrangement, the cover or a respective cover element first sinks or rises at one end while the opposite end follows this movement subsequently. This facilitates the flowing of the liquid from one side of the cover to the other side when the cover sinks or rises so that, contrary to the cover disclosed in the U.S. patent, almost no displacement forces are created when the cover sinks or rises. Furthermore, the cover of the present invention operates with relatively small sources of gas under pressure of low capacity. For instance, it has been found that a powerful domestic vacuum cleaner constitutes a sufficient gas pressure source for operating the cover of an average-sized swimming pool. Also, it is not necessary to provide aesthetic configurations at the bottom of the pool since the bottom is hidden by the cover and the latter may have a suitable surface design.

The above and other objects, advantages and features of this invention will become more apparent from the following detailed description of certain now preferred embodiments thereof, taken in conjunction with the accompanying schematic drawing wherein FIG. 1 shows a top view of a pool with a cover according to the invention;

FIG. 4, 5 and 6 are end views of further embodiments of cover elements;

FIG. 7 is a sectional view showing a vent valve;

FIGS. 9 and 10 illustrate another embodiment of a cover according to the present invention; and FIG. 11 shows a profile of a cover element.

Figure 1:
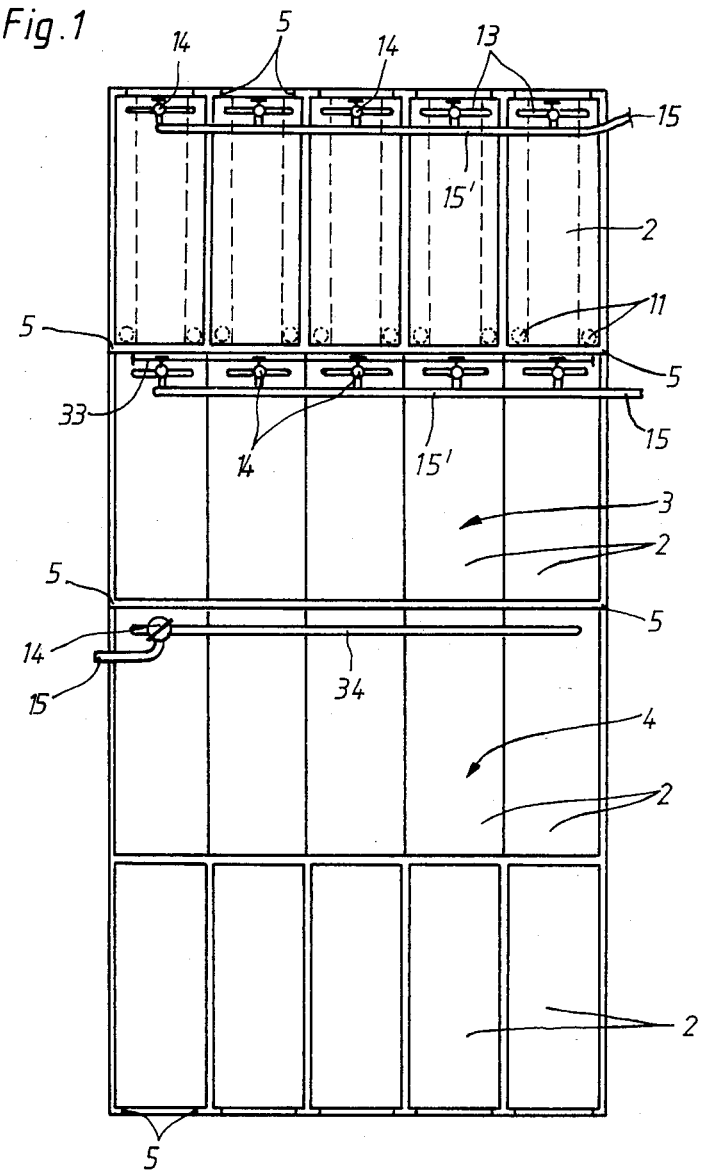

As shown in the embodiment of FIG. 1, the cover for pool 1 comprises a plurality of cover elements 2, the cover elements covering a center portion of the pool being combined into two groups 3 and 4 of cover elements 2. The cover elements combined into a respective group are interconnected, the outer cover elements being equipped with guide elements 5, such as eyelets, engaging vertical guides, such as tension cords 26 passing through the eyelets (FIG. 2), on the side walls of the pool along the long sides of the rectangular pool. On the other hand, cover elements 2 adjacent the small sides of the rectangular pool are individually vertically displaceable. These cover elements, too, have guide elements 5 at the small sides thereof and these guide elements are similarly engaged with vertical guides in the side walls of pool 1.

As will be noted from FIGS. 3 to 6, each cover element 2 defines two or more elongated boxes defining cavities 6 (FIGS. 3, 4 and 6), or 7, 8 (FIG. 5) and web or plate 10 connects the boxes. The web is comprised of a material of good absorptive properties or has a side facing away from the liquid coated with such a material. This arrangement not only provides a simple structure for the cover but the radiation-absorptive properties of the cover elements improves the energy balance in the immersed state of the cover, particularly in a swimming pool having a depth up to about two meters.

Single opening 11 facing the liquid in the pool is arranged at one end of each cavity for flooding said cavity and a short feed pipe 12 (FIG. 4) may lead to the opening although this is not essential, being absent, for example, in the embodiment of FIG. 5. In this embodiment, the cross section of the cavities is roound, cavity 7 being cylindrical and two hemi-spherical throughs 8 being screwed together along flanges to form a cavity. The cavities of the cover elements are interconnected by duct 13 constituting a connection to a source of gas under pressure, such as air, leading to the cavities for supplying the gas under pressure to the cavities whereby the liquid in the cavities is displaced.

As appears from FIG. 4, a respective air duct 13 leads into box-shaped cavities and the air ducts lead to valves 14. As shown in FIG. 1, the valves connect the air ducts to air distributing header 15' and flexible tube 15 connects header 15' to the gas source for supplying air under pressure to the cavities.

It may be advantageous to make the cover elements of a material of a specific weight exceeding that of the liquid contained in pool 1, which will eliminate the need for ballast to make the cover sink. The mass of the cover exceeds that of the liquid being displaced by the cover having flooded cavities.

FIG. 7 shows a particular embodiment of vent valve 14. The valve housing 16 has two or as shown in broken lines, three nipples 17 for connection to ducts 13 for two (FIGS. 4 and 5) or three (FIG. 6) cavities. Check valve 19 is arranged in a short feed pipe 18 and air distributing header 15' is connected to the feed pipe. Check valve 19 is in direct communication with chamber 20 to . Bores 21 bores 21 of nipples 17 lead which are in a constant communication with the cavities and valve chamber 20 may be closed at an upper end by a valve flap 22. The valve flap is mounted on a pivoting axle 23 and may be opened or closed by operating handle 24.

Obviously, the vent valve may be opened or closed by any suitable means, the pivotal valve flap being replaced, for example, by a sliding element or any other closure which may be operated to open and close the valve, preferably with an arrangement assuring a short operating path during actuation.

When the cover element floats on the liquid and valve flap 22 is opened to vent the cavity, air will escape from the cavity and will be displaced by liquid entering through flooding opening 11 into the respective cavity.

This will cause cover element 2 to begin sinking at the end close to the flooding opening because the air under pressure supplied to the cavity will no longer displace the liquid but the liquid will be able to enter the cavity as the air escapes therefrom.

Figure 2:
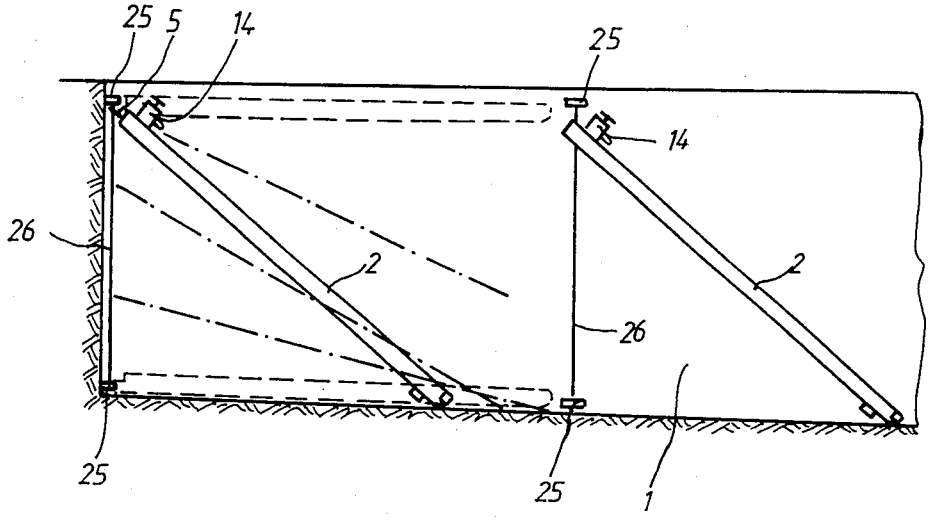
FIG. 2 is a sectional view of the pool with a partially sunk cover.

FIG. 2 shows the end positions of cover element 2 in broken lines while intermediate positions of the cover element are indicated in chain-dotted lines.

When it is desired to float cover element on the surface of the liquid again, vent valve 14 is closed and gas under pressure is supplied to the cavity through connection 15, 15'. This will displace the liquid in the cavity and the liquid will escape therefrom through opening 11. This will cause the cover element to rise at an end thereof opposite to the end close to the flooding opening and, when all the liquid in the cavity has been displaced, the cover element will float on the surface of the liquid, at which point further supply of gas under pressure is discontinued and check valve 19 closed. Check valve 19 and closed valve flap 22 assure the tight closure of the cavity in the cover element so that no liquid will enter the cavity and the cover element will remain floating. The particular valve arrangement shown in FIG. 7 further reduces the necessary number of bores in the cover element for providing connections to the cavity.

FIG. 2 also shows a preferred embodiment for guiding cover elements 2 during their vertical displacement and for securing them in their end positions. The illustrated guide comprises mounting supports 25 affixed to the side walls of pool 1 near the water level and the bottom of the pool, a guide rod or tensioned cord 26, for example of nylon, extending between the mounting supports and receiving eyelets 5 affixed to the cover elements. The eyelets may be replaced by hooks whose openings face each other or face away from each other, which makes it possible to attach the hooks while making use of the elasticity of rods or cords 26.

Figure 3:
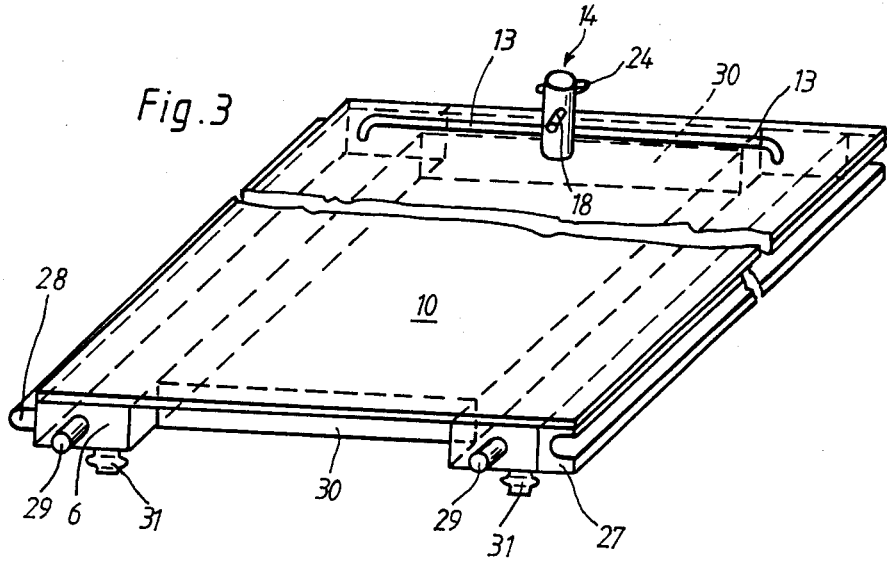
FIG. 3 is a perspective view of a cover element.

In the embodiments described hereinabove, the cover comprises at least two groups of cover elements 2 extending over the length of pool 1 and each cover element defines a respective cavity 6, 7, 8. The connection to the gas under pressure comprises a common tube for the cavities of each group of cover elements. This arrangement is particularly useful for large swimming pools, such as used for sports events. As shown in FIG. 3, connecting means are provided for the cover elements of each group, the illustrated connecting means being comprised of resilient strips 28 arranged along respective edges of the cover elements and fitting into corresponding grooves 27 defined in corresponding edges of adjacent cover elements. Thus, each cover element has a resilient strip 28 along one edge and a groove 28 along an opposite edge. This will provide a tongue-and-groove snap connection between adjacent cover elements. Furthermore, one of the ends of the cover elements carries pins 29 for connection to an adjacent cover elements so as to avoid separation of the interconnected cover elements in a transverse direction. Such connecting means between the cover elements forms groups 3 and 4 of cover elements which can be displaced vertically in common. The pins may be threaded so as to receive nuts affixed to the ends of adjacent cover elements.

In the embodiment of FIG. 3, transverse struts 30 interconnect boxes 6 near the ends thereof, the connection being air-tight along the side walls of cavities 6 and at the underside of web 10 so that the space betwen struts 30 and cavities 6 may be filled with liquid when the space has been vented. In this manner, full contact between the liquid and web 10 of the cover element is assured when the cover element floats on the liquid. Since the web has good radiation-absorptive properties, it will be heated by impinging radiation and will transmit the heat to the liquid in an effective heat exchange. It is preferred to space transverse struts 30 a little from the ends of box-shaped cavities 6 to prevent air from entering the space enclosed by the struts and cavities when the cavities are flooded and the cover element begins to sink by assuming an oblique position. Such an air influx would interfere with the sinking of the cover element.

Upper mounting supports 25 for this vertical guides of the cover elements are arranged at or slightly above the water level so that guide elements 5 of the cover elements abut the mounting supports even at a verys light inclination of the cover elements and prevent a rising of the cover elements at the beginning of the flooding of cavities 6, 7, 8 out of the water at the ends of the cover elements which hold vent valve 14.

As shown in FIG. 2, the ends 9 of the boxes defining the cavities may be rounded so as to facilitate gliding of the boxes along the bottom of the pool during sinking of the cover. This gliding movement may be further enhanced by placing elastic tube pieces 31 over feed pipes 12 (FIG. 4).

In the embodiment of FIG. 4, wherein the cover also comprises a plurality of cover elements and each cover element has two boxes defining cavities 6, two webs 10 and 32 connect the web 32 at the upper side of the defining cavities being of transparent material, preferably glass-clear, and web 10 at the underside of the boxes cavities having a surface facing web 32 and having good absorptive properties. The radiation-absorbing web is, therefore, always in good contact with the liquid underlying it and the overlying transparent web provides a certain green-house effect. The air cushion between webs 10 and 32 reduces the reflection of the heat to the atmosphere at times, such as at night, when the temperature of the liquid in the pool exceeds that of the atmosphere. This arrangement produces excellent utilization of the impinging heat radiation in the floating and in the immersed position of the cover.

Figure 8:
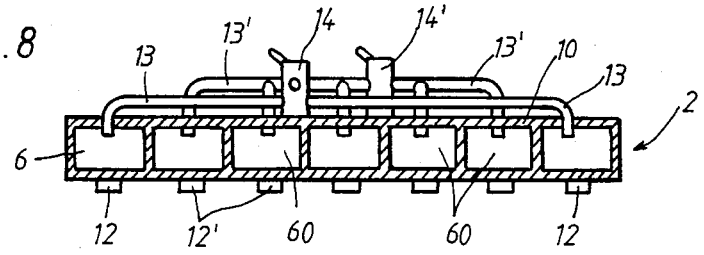
FIG. 8 is a sectional view showing another embodiment of a cover element.

The embodiment of the cover element 2 shown in FIG. 8 provides selectively good insulation of the covered liquid against reflection of the heat to a cooler atmosphere and good contact of the covered liquid with a strongly absorbing surface of a web connecting the cavities of the cover element. In this embodiment, the cover element has two groups of boxes defining cavities 6 and 60, respectively, and web 10 connects the boxes, the web being integral with the boxes in the illustrated embodiment. Common venting duct 13 vents cavities 6 of the one group and common venting duct 13' vents cavities 60 of the other group. Respective venting valve 14 and 14' is mounted in each venting duct and the connection to the source of gas under pressure leads to the cavities of at least one of the groups. The venting valves may have the structure illustrated in FIG. 7. The connection leads to the cavities through the vent valves in the common venting duct for the one group.

When this element is first to be lowered, valves 14 and 14' are opened to flood all cavities 6 and 60. When the two valves remain closed and gas under pressure is blown into cavities 6, cover 2 rises while boxes 60 remain filled with liquid, thus providing a good heat exchange between web 10 and the covered liquid. When it is desired to provide an insulating layer against loss of heat, for instance during night hours, between web 10 and the covered liquid, valve 14' is opened to empty cavities 60 and permit air to flow thereinto. If it is desired to increase the carrying capacity of the cover, valve 14' may then be closed again whereby air-filled cavities 60 will serve as lifting forces.

As shown in FIG. 1, operating handles 24 for valves 14 belong to one group 3 of cover elements may be mechanically coupled by coupling element 33 so that all valves of the group may be actuated simultaneously. The coupling element may be a rod linked to handles 24. Valves 14' of the embodiment of FIG. 8 may similarly be mechanically coupled together for simultaneous actuation.

Another arrangement for the common venting of, or gas supply to the, cavities of a group 4 of cover elements 2 is also shown in FIG. 1. This comprises common duct 34 connected to all the cavities of the cover elements of the group and a single vent valve 14 controls the gas flow through this common duct at a cover element 2 on the edge of the cover. Operation of the common valve will enable air to be vented from all the cavities of this group of cover elements or to supply air thereto for respectively sinking or lifting the group of cover elements together. When the cover floats, valve 14 may readily be operated manually and when the cover is immersed, it may be operated by a rod immersed in the water and having a gripping element at its end for gripping the valve operating handle.

The cover of the present invention provides a novel covering for a pool of any size or shape and provides a flat surface capable of absorbing environmental radiation. Compared to known roller or roof covers, this coverying may be sunk to the bottom of the pool. In this position, the absorptive cover surface functions as an absorber at the bottom of the pool while it enhances the heat absorption when it is in the floating position. The cover may be of modular structure being comprised of a plurality of cover elements each having cavities interconnected by a radiation-absorptive web to provide a load-carrying system.

Depending on the size and shape of the pool, the cover may be comprised of a plurality of groups of cover elements arranged transversely adjacent each other (FIG. 9) or longitudinally adjacent (FIG. 2), each group of cover elements being capable of floating on the liquid in the pool.

The two cover elements connected at their ends facing the atmosphere are connected to a centrally arranged flexible tube leading to the vent valve which is closed to prevent escape of air from the cover cavities and is opened to permit flooding of the cavities. Next to the vent valve, a ball valve is provided to enable the gas under pressure, i.e. air, to be supplied to the cavities. The flooding opening is provided at the opposite end of each cavity and must be so arranged that the cavity will not be supplied with air due to any load or positioning of the cover element.

When the cavities of the cover are filled with air, the cover will float on the liquid at an immersion depth corresponding to the weight of the cover and the displacement of liquid thereby. This pneumatic-hydraulic system is in balance since there is equilibrium between the flooding openings and the atmospheric air.

Upon fully or partially opening vent valve 14, air escapes from the cavities and permits liquid from the pool to enter thereinto through flooding openings 11. This will depress the end of the cover equipped with openings 11 so that the cover will assume a position extending obliquely to the bottom of the pool. The speed of sinking depends on the amount of air escaping from the cavities. Rising of the opposite end of the cover above the liquid level will be prevented by the guide arrangement described hereinabove in connection with FIG. 2.

The cover remains in stable equilibrium during each phase of flooding. Any time the vent valve is closed during flooding, the cover remains in the position assumed at that time. This makes it possible to adjust the position of the cover in the liquid so that the pool may be used for children, for example, or for non-swimmers in the area of the pool not covered by the cover.

Depending on the rigidity of the entire cover, it may assume a curved shape during the flooding, depending on the static conditions prevailing. When the buoying air in the cavities has been entirely displaced by the liquid, the cover will sink to the bottom of the pool, various cover positions being shown in FIG. 2.

When the cover is drained, the vent valve is closed and air is supplied to the cavities through check valve 19 from a turbine or a strong domestic vacuum cleaner. The gas under pressure displaces the liquid in the cavities, beginning at the ends of the cavities near the vent valve, and the liquid flows out of the cavities at the other ends through openings 11.

Covers having a length between about 8 and 12 meters will require a period of about 2 to 3 minutes for flooding and draining. The kinetics of flooding and draining are such that no water is displaced in the pool, i.e. the liquid in the pool is not moved during flooding or draining of the cover but remains still.

Swimming pools with a water surface of about 30 to 100 square meters require a source of gas under pressure, i.e. a compressor, of a capacity that need not exceed about 150 liters/minute.

To assure good absorptive properties for the cover of the pool, the following conditions should be met:

(1) The connecting web of the cover must be made of, or coated with, a material having good absorptive properties. Dull black surfaces are very suitable for this purpose.

(2) In the floating condition, the absorptive surface of the cover should be in direct contact with the liquid in the pool. Air cushions between the liquid level and this surface substantially reduce the heat exchange between the absorptive surface and the liquid.

A cover element of the type shown in FIG. 8 very well meets these conditions.

Another very useful heat-exchange structure is shown in FIG. 4 where the cavities are arranged between a transparent web and an absorptive web.

Figure 9:
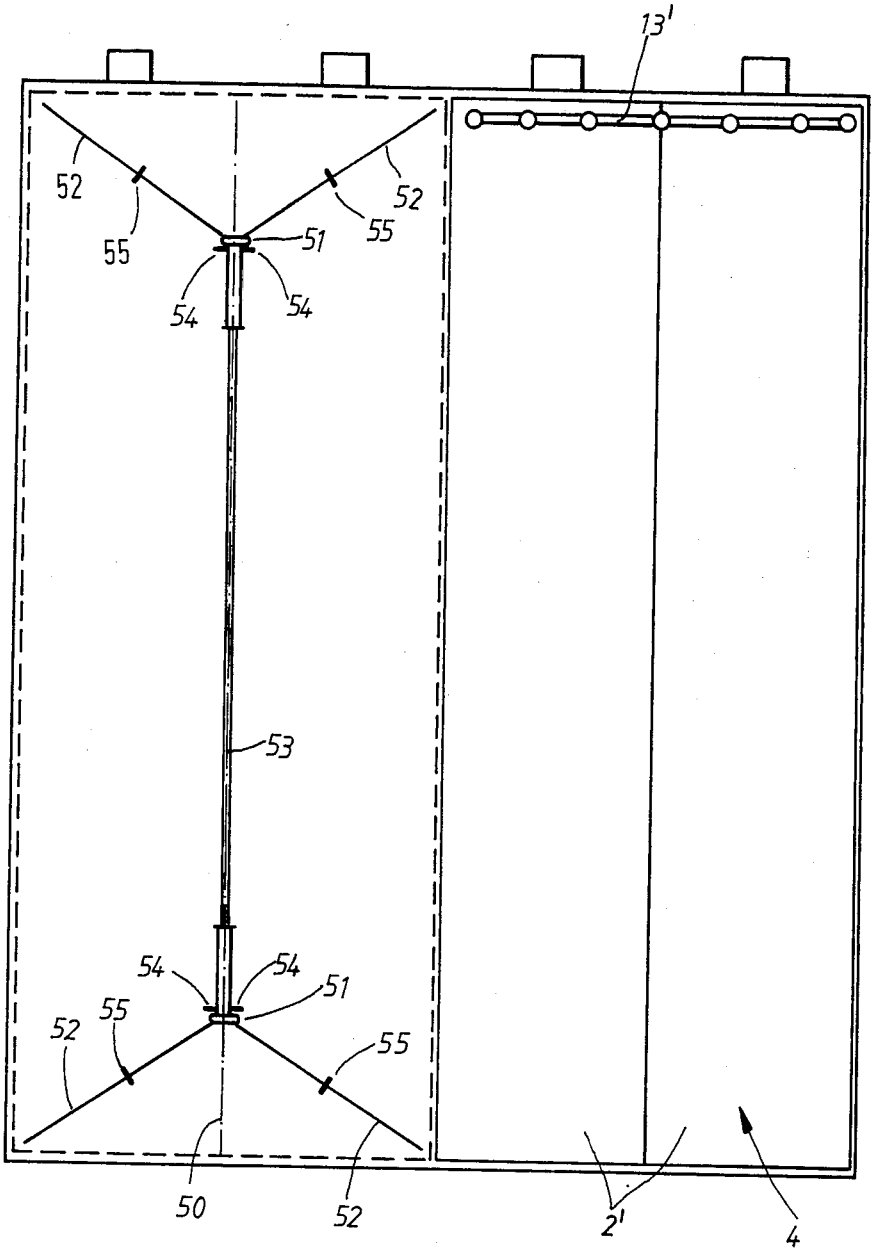

FIGS. 9 and 10 show another embodiment. The pool cover of this embodiment comprises a plurality of cover elements 2' interconnected to form groups 4 of cover elements. Each group 4 of cover elements is rectangular and has two opposite small sides. The cover elements extend along the entire length of the pool to be covered and are interconnected at the long sides by the type of tongue-and-groove coupling shown in FIGS. 3 and 11.

FIG. 9 shows only right group 4 in the floating condition while the left group of cover elements has been removed and is indicated only by broken lines projected on the bottom of the pool. For guiding each group 4 of cover elements 2', a respective cable 52 has an end affixed to a respective end of each small side of the group and the two cables at each small side are pulled through a respective guide element 51 arranged in a vertical plane defined by longitudinal center line 50 of the rectangular group of cover elements. Guide elements 51 are anchored to the bottom of the pool and are comprised of double eyelets in the illustrated embodiment. Elongated resilient pulling element 53, which may be a rubber cord, is attached to the other ends of the four cables pulled through guide elements 51. Abutments 54 and 55 on cables 52 engage the guide elements for determining end positions of the group of cover elements. Abutments 55 determine the lowered end position while abutments 54 determine the floating position of the cover and also protect the cover from being lifted off by a squall of wind. The resilient pulling element must retain some tension in the lowered position of the cover so that abutments 55 will be pressed against guide elements 51 and thus hold the cover elements in a predetermined lowered position.

As shown in FIG. 10, three-way valves 56 connect flexible tubes 15 to a source of gas under pressure (not shown) and the tubes lead into the cavities of cover elements 2' of groups 4 from below through air ducts 13'.

FIG. 11 shows a preferred profile for a cover element 2' extending over the entire length of a pool to be covered. This profile shows a resilient strip 28' having thickened portion 72 and a widened end portion 73 encompassed by a corresponding wall portion of groove 27' with some play when two adjacent cover elements are coupled together. This, as has been pointed out hereinabove, increases the tilting safety of the cover when walked upon.

Due to the arrangement of large covers 2' running from wall to wall of the pool there is no danger of any one element tilting when walked on. Said property is further enhanced if said large covers 2' are interconnected into groups 4. This enables an operator to walk safely on the floating cover for cleaning the same, for example, in case the cavities are of a corresponding largeness. In this connection, it is particularly advantageous if the resilient strips of the cover element connecting means have thickened portions and the corresponding grooves have corresponding wall portions loosely encompassing the thickened portions. This will not only assure a good and safe interconnection of the cover elements of one group but, at the same time, provides sufficient play therebetween to enable the cover elements of the group to move relatively to each other. This play also enables the cover to remain laying on the bottom of the pool during the winter if the cover is made of a material withstanding cold weather. Any film of water which would freeze along the walls of the grooves or the strips will not cause any deformation since the increase in volume will be accommodated by the play between the thickened strip portions and the corresponding groove wall portions. Since the bottom of the pool is usually oblique, no accumulation of large amounts of liquid in the grooves of the cover elements will occur.

What is claimed is:

1. A flat, elongated cover for a pool having a bottom and side walls, the pool containing a liquid, the cover being substantially rigid and having a side facing the liquid and an opposite side facing away from the liquid when the cover is in a floating position on the liquid, and the cover defining at least one elongated cavity extending in the direction of elongation of the cover, each cavity having a single flooding opening facing, and in free communication with, the liquid, the flooding opening being arranged in the region of one end of the cavity for flooding the cavity, a venting port arranged in the region of an end of the cavity opposite to the one end, a vent valve for closing and opening the venting port, and a connection to a source of a gas under pressure leading to the cavity for selectively supplying the gas under pressure to the cavity, the mass of the cover in addition to that of the liquid flooding the cavity exceeding the mass of the liquid to be displaced whereby the cover will gradually sink to the bottom when the liquid floods the cavity through the single flooding opening at the one end after the vent valve has been opened to permit the gas under pressure to escape through the venting port at the opposite end, the cover assuming an oblique position while it sinks as the liquid gradually floods the cavity from the one to the opposite end, and the cover gradually rising in a like manner when the gas under pressure is supplied to the cavity and gradually displaces the liquid in the cavity through the opening at the one end.

2. The pool cover of claim 1, comprising a plurality of cover elements, each cover element having at least two boxes defining cavities, and a web connecting said boxes.

3. The pool cover of claim 2, wherein the web has a side facing away from the liquid and coated with a material of good absorptive properties.

4. The pool cover of claim 2, wherein the web is comprised of a material of good absorptive properties.

5. The pool cover of claim 1, comprising a plurality of cover elements, each cover element having at least two boxes defining cavities, and two webs connecting said boxes, one web being of transparent material and the other web having a surface facing the transparent web and having good absorptive properties.

6. The pool cover of claim 1, comprising a plurality of cover elements, each cover element having two groups of boxes defining cavities, and at least one web connecting the boxes the cavities of each of said two groups of cavities are connected by a common venting duct provided with a vent valve and a connection to the source of gas under pressure is provided leading to the cavities of at least one of the groups.

7. The pool cover of claim 6, wherein the connection to the source of gas under pressure leads to the cavities through the vent valve in the common venting duct for the one group.

8. The pool cover of claim 1, comprising at least two groups of cover elements extending over the length of the pool, and the connection to the source of gas under pressure comprising a common tube for the cavities of each group of cover elements.

9. The pool cover of claim 8, further comprising means for connecting the cover elements of each group, the connecting means being comprised of resilient strips arranged along respective edges of the cover elements and fitting into corresponding grooves defined in corresponding edges of adjacent ones of the cover elements.

10. The pool cover of claim 9, wherein the resilient strips have thickened portions and the corresponding grooves have corresponding wall portions loosely encompassing the thickened portions.

11. The pool cover of claim 1, comprising a plurality of cover elements combined into groups of cover elements, the vent valves of the cover elements of each group being interconnected and actuatable together.

12. The pool cover of claim 11, further comprising a flexible tube for the connection to the source of gas under pressure and leading to a connection at an underside of one of the cover elements of each group, at least in a region close to the bottom of the pool said tube being held at a wall of the pool, a distribution system being connected to the tube for supplying the gas to all the cover elements of the group.

13. The pool cover of claim 1, comprising a plurality of cover elements interconnected to form groups of cover elements, each group of cover elements being rectangular and having two opposite small sides, and further comprising a respective cable having an end affixed to a respective end of each small side, a respective guide element through which the two cables affixed to the same small side are pulled, the two guide elements being arranged in a vertical plane defined by a longitudinal center line of the rectangular group of cover elements, an elongated resilient pulling element attached to the four cables pulled through the guide elements, and abutments on the cables for engagement with the guide elements for determining end positions of the group of cover elements.

14. The pool cover of claim 13, wherein the guide elements have a distance from the end walls of the pool substantially equal to the depth of the pool.

15. The pool cover of claim 1, comprising a plurality of cover elements, each cover element being rectangular and having two opposite small sides, and further comprising a respective cable having an end affixed to a respective end of each small side, a respective guide element through which the two cables affixed to the same small side are pulled, the two guide elements being arranged in a vertical plane defined by a longitudinal center line of the rectangular group of cover elements, an elongated resilient pulling element attached to the four cables pulled through the guide elements, and abutments on the cables for engagement with the guide elements for determining end positions of the cover element.

16. The pool cover of claim 15, wherein the guide elements have a distance from the end walls of the pool substantially equal to the depth of the pool.

17. The pool cover of claim 1, further comprising a short feed pipe associated with each vent valve, the feed pipe communicating constantly with the cavity, a check valve arranged in the feed pipe and a flexible tube connected to the feed pipe.

* * * * *